US005538682A

United States Patent [19]

Bornmann et al.

[11] Patent Number: 5,538,682

[45] Date of Patent: Jul. 23, 1996

[54] PROCESS FOR PRODUCING SPUNBONDED WEBS

[75] Inventors: Uwe Bornmann; Manfred Winkler; Heinz Schörgenhuber, all of Linz, Austria

[73] Assignee: Polyfelt Gesellschaft m.b.H., Linz, Austria

[21] Appl. No.: 317,626

[22] Filed: Sep. 30, 1994

[30] Foreign Application Priority Data

Sep. 30, 1993 [AT] Austria ..... 1963/93

[51] Int. Cl.[6] ..... D01D 5/098; D01D 11/02

[52] U.S. Cl. ..... 264/555; 264/103; 264/210.8; 264/211.14

[58] Field of Search ..... 264/103, 210.8, 264/211.12, 211.14, 211.15, 555

[56] References Cited

U.S. PATENT DOCUMENTS

| | | | |
|---|---|---|---|
| 3,692,618 | 9/1972 | Dorschner et al. | 428/227 |
| 4,818,466 | 4/1989 | Mente et al. | 264/555 |

FOREIGN PATENT DOCUMENTS

| | | |
|---|---|---|
| 1510245 | 1/1970 | Germany . |
| 2016860 | 10/1971 | Germany . |
| 2526364 | 12/1976 | Germany . |
| 1285381 | 8/1972 | United Kingdom . |
| 2204886 | 11/1988 | United Kingdom . |

OTHER PUBLICATIONS

Chemical Abstract 76–73693g (Abstract of German 2,016,860 Published Oct. 28, 1971).

Derwent 70–00309R/01 (Abstract of German 1,510,245 Published Jan. 02, 1970).

Derwent 77–02173Y/02 (Abstract of German 2,526,364 Published Dec. 30, 1976).

*Primary Examiner*—Leo B. Tentoni

*Attorney, Agent, or Firm*—Wenderoth, Lind & Ponack

[57] ABSTRACT

A spunbonded web is produced by melting a thermoplastic polymer to form a melt, spinning the melt downwardly through spinnerets to form filaments, cooling the filaments, drawing the thus cooled filaments by take-off nozzles into the form of filament strands, passing the filament strands through guide tubes and by the guide tubes directing the thus guided filament strands downwardly therefrom toward a laydown apparatus, and laying down the filament strands in the form of a web on the laydown apparatus and moving the web in a take-off direction. Adjacent of the filament strands are guided, due to orientation of respective adjacent guide tubes thereof in different downward directions at respective different angles relative to the takeoff direction, to the laydown apparatus in respective different directions at said respective different angles.

5 Claims, 1 Drawing Sheet

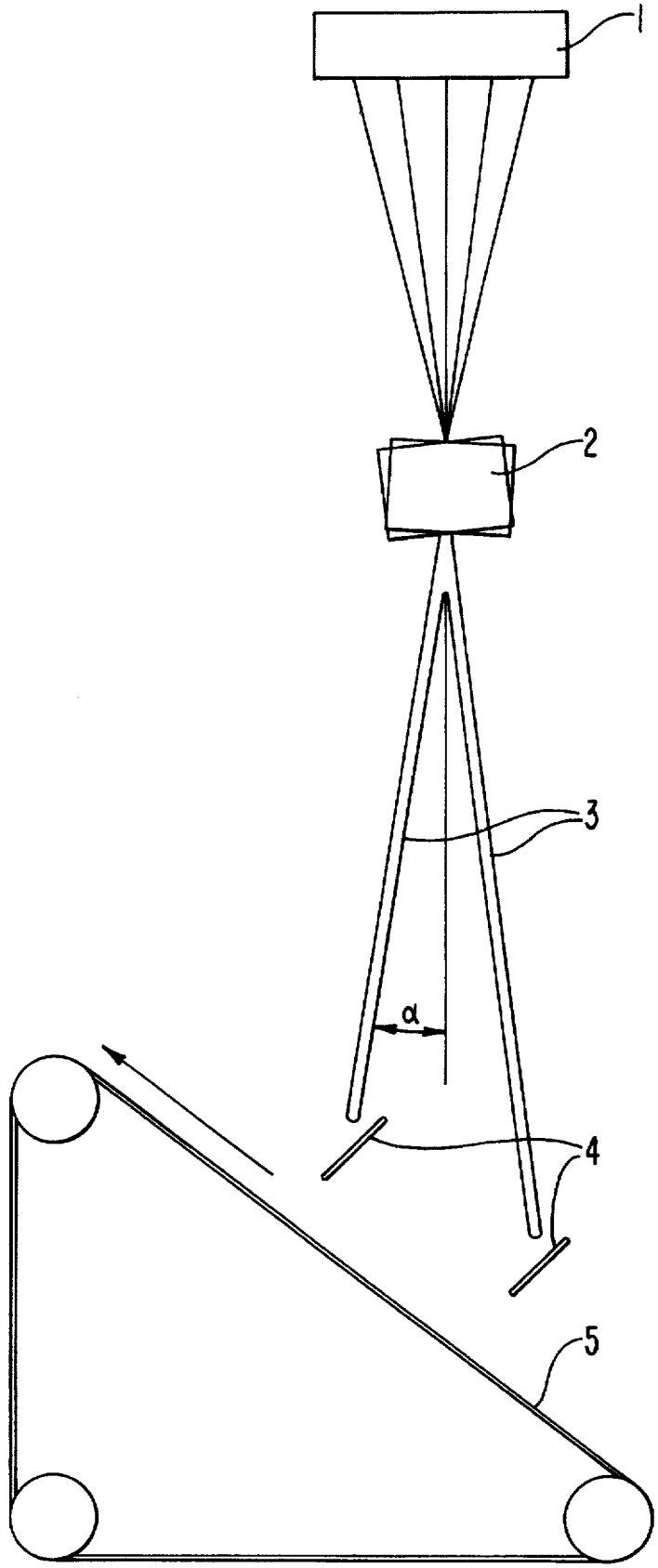
1
2
3
α
4
5

PROCESS FOR PRODUCING SPUNBONDED WEBS

BACKGROUND OF THE INVENTION

The invention relates to a process for producing spunbonded webs and to an apparatus for carrying out the process.

As is known for example from U.S. Pat. No. 3,692,618 or U.S. Pat. No. 4,818,466, spunbonded webs can be produced by extrusion of liquid melts of thermoplastics, e.g. polyolefins, polyesters or polyamides, through multiple hole spinnerets, cooling and drawing, for example by pneumatic drawing via take-off nozzles using air, and laydown of the resulting continuous filaments on a moving belt in the form of a random web. These webs may subsequently be consolidated, for example by needling. To obtain better guidance of the drawn filaments, it is customary to guide the filaments coming in the form of strands from the take-off nozzles downwardly through perpendicular guide tubes toward the laydown apparatus, where they are laid down in the form of a web on a moving belt, for example with the aid of impingement panels. However, the linear arrangement of the laydown systems, in which the individual laydown systems are disposed side by side in a row, greatly restricts the capacity of such spinning plants. True, there are processes in existence which utilize a plurality of successive rows of laydown systems to increase the throughput, but there the row arrangement is achieved by allocating to each row of laydown systems a spinning plate or a row of spinning plates. This requires either extremely complex spinning manifolds or even a plurality of separate spinning systems made up of an extruder, pipework for the melt, and a spinning manifold. Nor is it possible with these systems to use one row of spinning plates to serve a plurality of laydown systems. Moreover, the distances between the individual laydown systems are very small. This limits the laydown footprint associated with each laydown system. The individual filament curtains come to interfere with each other at the boundary lines between the individual laydown systems, which has an adverse effect on web properties.

SUMMARY OF THE INVENTION

It has now been found that the cited disadvantages of existing spunbonded web processes can be avoided by guiding at least some of the filament strands downwardly at an inclined angle by means of inclined guide tubes. What was surprising here is that the running properties of the filaments are not adversely affected despite the inclined disposition of the guide tubes.

The invention accordingly provides a process for producing spunbonded webs by melting a thermoplastic polymer, spinning the melt downwardly through spinnerets to form filaments, cooling the filaments, drawing the cooled filaments by means of take-off nozzles in the form of filament strands, and passing the strands of drawn filaments through guide tubes to a laydown apparatus to lay them down in the form of a web. At least some of the filaments are made by the guidance provided by the guide tubes to impinge on the laydown apparatus, for laydown in web form, at different angles $\alpha$ relative to the perpendicular and inclined forwardly or rearwardly in the take-off direction of the web, adjacent filament strands having different angles $\alpha$.

The present invention further provides an apparatus for producing spunbonded webs from thermoplastic polymers, comprising a melting means for the polymer, one or more downwardly leading spinneret orifices from which thermoplastic filaments are spun, a cooling zone for cooling the filaments, one or more take-off nozzles for the filaments, one or more downwardly extending filament-guide tubes fixedly positioned downstream of the take-off nozzles, and a laydown apparatus for the filaments forming the spunbonded web. At at least some of the guide tubes are fixedly disposed at different angles $\alpha$ relative to the perpendicular and inclined forwardly or rearwardly in the take-off direction of the web, adjacent guide tubes having different angles $\alpha$.

In a preferred process, the adjacent guide tubes are alternately inclined forwardly and rearwardly, so that the filament strands likewise impinge on the laydown apparatus alternately inclined forwardly and rearwardly, particularly preferably inclined forwardly by $+\alpha$ and rearwardly by $-\alpha$. However, it is also possible for only every second guide tube to be inclined, with the in-between guide tubes leading perpendicularly downwardly. It is further possible for the guide tubes to be inclined forwardly by different angles $\alpha$ and/or rearwardly by different angles $\alpha$. The angle $\alpha$ ranges from about 1° to 45°, depending on the nature of the web, the production speed, the length of the guide tubes, and the distance between the guide tubes. Preferably the angle $\alpha$ is set to not more than 20°, particularly preferably to not more than 10°.

The at least partly inclined downwardly take-off direction of the filament strands according to the invention has the decisive advantage at laydown that it gives rise to two or more rows of laydown systems, and at the same time the distances between the laydown means of a row of laydown systems are greater. This makes it possible to lay down the filaments of a laydown apparatus over a broader area without affecting the other filaments. Additionally, this results in a more intensive crossing of the individual filaments or filament bundles and hence in improved mechanical properties and also a more uniform web.

BRIEF DESCRIPTION OF THE DRAWING

Other objects, features and advantages of the present invention will be apparent from the following detailed description, taken with the accompanying drawing, wherein the single figure illustrates schematically the process of the present invention.

DETAILED DESCRIPTION OF THE INVENTION

The single figure shows a diagram of a possible arrangement of guide tubes in a spunbonded web plant. (1) designates a spinneret, (2) take-off nozzles, (3) forwardly and rearwardly inclined guide tubes, ($\alpha$) the angle of inclination of the guide tubes relative to the perpendicular, (4) impingement panels or deflectors, and (5) a moving belt on which the filaments are laid down in the form of a web. The arrow indicates the production direction. Depending on the web width, one or more spinnerets are arranged side by side in a row, each spinneret producing a web from about 10 to 100 cm in width, depending on the configuration of the plant.

The take-off nozzles may be disposed parallel to the spinnerets or else preferably be disposed perpendicularly on top of the guide tubes.

To increase the capacity of the spunbonded web plant further, it is also possible to arrange the spinnerets in a plurality of successive rows of spinning plates, each row of spinning plates being assigned at least two successive rows of laydown systems.

What we claim is:

1. A process for producing spunbonded webs, said process comprising:

melting a thermoplastic polymer to form a melt;

spinning said melt downwardly through spinnerets to form filaments;

cooling said filaments;

drawing the thus cooled filaments by means of take-off nozzles into the form of filament strands;

passing said filament strands through guide tubes and by said guide tubes directing the thus guided filament strands downwardly therefrom toward a laydown apparatus;

laying down said filament strands in the form of a web on said laydown apparatus and moving said web in a take-off direction; and guiding adjacent of said filament strands, due to orientation of respective adjacent said guide tubes thereof in different downwardly directions at respective different angles relative to said take-off direction, to said laydown apparatus in respective directions that are different from each other and at said respective angles that are different from each other.

2. A process as claimed in claim 1, wherein alternate of said filament strands are guided to said laydown apparatus in respective directions inclined forwardly and rearwardly, with respect to said take-off direction, of vertical.

3. A process as claimed in claim 1, wherein said direction of each said filament strand is inclined to vertical by an angle of no more than 20°.

4. A process as claimed in claim 1, wherein said direction of each said filament strand is inclined to vertical by an angle of no more than 10°.

5. A process as claimed in claim 1, wherein every second said filament strand is guided in a direction inclined forwardly or rearwardly, with respect to said take-off direction, of vertical, and in-between said filament strands are guided vertically.

* * * * *